US006216769B1

(12) United States Patent
Wetter et al.

(10) Patent No.: US 6,216,769 B1
(45) Date of Patent: Apr. 17, 2001

(54) PROCESS FOR GUIDING A SLAB AND SLAB-GUIDE

(75) Inventors: Jakob Wetter, Krefeld; Johannes Schwedmann; Rüdiger Blask, both of Duisburg, all of (DE)

(73) Assignee: Mannesmann AG, Düsseldorf (DE)

( * ) Notice: Subject to any disclaimer, the term of this patent is extended or adjusted under 35 U.S.C. 154(b) by 0 days.

(21) Appl. No.: 09/214,086

(22) PCT Filed: Jun. 23, 1997

(86) PCT No.: PCT/DE97/01342

§ 371 Date: Dec. 28, 1998

§ 102(e) Date: Dec. 28, 1998

(87) PCT Pub. No.: WO98/00253

PCT Pub. Date: Jan. 8, 1998

(30) Foreign Application Priority Data

Jun. 28, 1996 (DE) ..... 196 27 336

(51) Int. Cl.[7] ..... B22D 11/12; B22D 11/20

(52) U.S. Cl. ..... 164/441; 164/442; 164/413

(58) Field of Search ..... 164/484, 454, 164/413, 442, 441

(56) References Cited

U.S. PATENT DOCUMENTS 5,018,569 * 5/1991 Burau et al. ..... 164/454
5,709,261 * 1/1998 Streubel ..... 164/454

* cited by examiner

*Primary Examiner*—Harold Pyon
*Assistant Examiner*—I-H Lin
(74) *Attorney, Agent, or Firm*—Cohen, Pontani, Lieberman & Pavane

(57) ABSTRACT

The invention is directed to a process for guiding a strand, especially a steel strand in a continuous casting plant with a soft reduction zone in which hydraulic servo units continuously adjust the gap width between oppositely located strand guide rollers. In a strand guiding segment with 4 servo piston-cylinder units, two adjacent servo piston-cylinder units are adjusted relative to the strand so as to be linked with one another hydraulically. The rest of the servo piston-cylinder units are adjusted independently. The invention is further directed to a strand guide.

5 Claims, 2 Drawing Sheets

74
73
13
17
81
75
76
31
63
41
53
82
12
11
16
15
83
A
84
22
21
26
25
85
32
42
77
24
78
72

PROCESS FOR GUIDING A SLAB AND SLAB-GUIDE

CROSS-REFERENCE TO RELATED APPLICATION

This application is a 371 of PCT/DE97/06342 filed Jun. 23, 1997.

BACKGROUND OF THE INVENTION

1. Field of the Invention

The present invention is directed to a process for guiding a strand in a continuous casting plant with a soft reduction zone in which hydraulic servo units continuously adjust the gap between oppositely located strand guide rollers, and to the corresponding strand guide for performing this process.

2. Description of the Prior Art

Continuous casting plants, especially continuous casting plants for steel, use rollers to guide the strand; these rollers limit the thickness of the strand which is not yet completely solidified and prevent bulging of the strand shell due to ferrostatic internal pressure.

Usually, groups of at least 4 pairs of rollers are combined in guide matter segments. The strand guide rollers arranged above the strand are fastened to a movable upper part, of the segment, while the strand guide rollers located below the strand are arranged at a fixed lower part, of the segment. The fixed part and movable part of the individual segment are connected with one another via 4 tension cylinders. These clamping cylinders, as they are called, pull the movable top part of the segment on spacers, so that the desired gap width results between the oppositely located rollers. This gap width of a segment of this type corresponds to the strand thickness.

A strand guide of the type mentioned above is known from DE 40 22 871 C2, wherein frame parts which carry the strand guide rollers that are located opposite to one another can be clamped relative to one another by means of a displacement device on one part of the segment until support devices contact counter-support devices which are provided with supporting surfaces located at different height positions and with counter-supporting surfaces, on the other part of the segment. The individual support disks are adjustable by means of rotation.

A device of this kind can only adjust a fixed gap width which cannot be readjusted during casting.

However, modern process technologies for improving product quality require that the gap width for a segment is changed during the casting process. In particular, soft reduction in the region of the lowest point of the liquid pool requires a wedge-shaped adjustment of the strand and a variable change in gap width of the corresponding segment.

A simple possibility for changing the gap width of segments with 4 clamping cylinders can be achieved in that the cylinders are constructed with position regulation as servo-hydraulic axles. In a solution of this type, the spacers, as they are called, can be dispensed with. The gap width of the segment is predetermined by a corresponding preset reference value for the 4 position-regulated piston-cylinder units. In so doing, the two servo units at the run-in end of the segment and the two servo units at the run-out end of the segment are regulated so as to be synchronized. Due to the use of a total of 4 servo units, this system is statically redundant.

DE 41 38 740 A1 discloses a process for the continuous casting of slabs or ingots in a continuous casting plant with a soft reduction zone which has rollers which can be continuously adjusted individually or as segments relative to one another by means of hydraulic cylinders and, with respect to their gap width, by means of spindles. The spindles can be moved to a desired gap spacing such that load is reduced. The movable part of the segment which is held in its position by four hydraulic cylinders is also statically redundant.

SUMMARY OF THE INVENTION

Therefore, it is the object of the invention to provide a process and a corresponding device for guiding a strand in a continuous casting plant in which the static redundancy brought about by the four-point support of the strand segment is eliminated and the tensioning of the movable parts of the segment brought about in this way is reduced.

This object is achieved by a process for guiding a strand having a soft reduction zone in a strand guiding segment of a continuous casting machine, the strand guiding segment having four servo piston cylinder units for adjusting a gap between oppositely arranged guide rollers of the strand guiding segment. In the process, two adjacent ones of the four servo piston-cylinder units are hydraulically linked and adjusted to the strand as a unit and the remaining servo piston-cylinder units are independently adjusted to the strand. The objects of the invention are also met by a strand guide for use in a continuous casting plant including a strand guide segment having oppositely arranged strand guide rollers defining a gap through which the strand is guidable. The strand guide segment includes four servo piston-cylinder units operatively connected for continuously adjusting the gap, wherein two of the servo piston-cylinder units are adjustable as a unit by a shared servo valve and the other of the four servo piston-cylinder units are independently adjustable by separate servo valves.

The subclaims indicate advantageous further developments of the invention.

According to the invention, in a strand guiding segment with 4 servo units, two adjacent servo units are linked with one another hydraulically and the rest of the servo units remain independently adjustable. As a result of the parallel connection of two cylinders to form a unit corresponding to communicating pipes with only one position regulator, the plane maintained by four cylinders is statically determinate and is transformed into three-point support.

The pair of cylinders connected with only one servo valve has one position transmitter per cylinder. A mean value is taken from the signals of the individual position transmitters of the servo piston-cylinder units which are combined with one another and this means value is supplied, as a position adjustment value, to the shared position regulator acting on both cylinders.

In an advantageous construction, the servo piston-cylinder units of the run-in or run-out of the strand guide segments are linked with one another. Each of the strand guide segments for a strand guide is preferably linked in the same way as the others; for example, all servo units connected at the run-in end are connected to a position regulator and all servo units connected at the run-out end are driven independently.

When a defined path value, for example, a distance that can be predetermined, is exceeded when determining the average value or other technical data pertaining to continuous casting, another pair of servo piston-cylinder units can be linked with one another.

BRIEF DESCRIPTION OF THE DRAWINGS

An example of the invention is shown in the accompanying drawing.

FIGS. 1 and 2 show a strand guide segment 81 with strand guide rollers 82 to 87. The strand guide direction is indicated by an arrow A.

Figure 1:
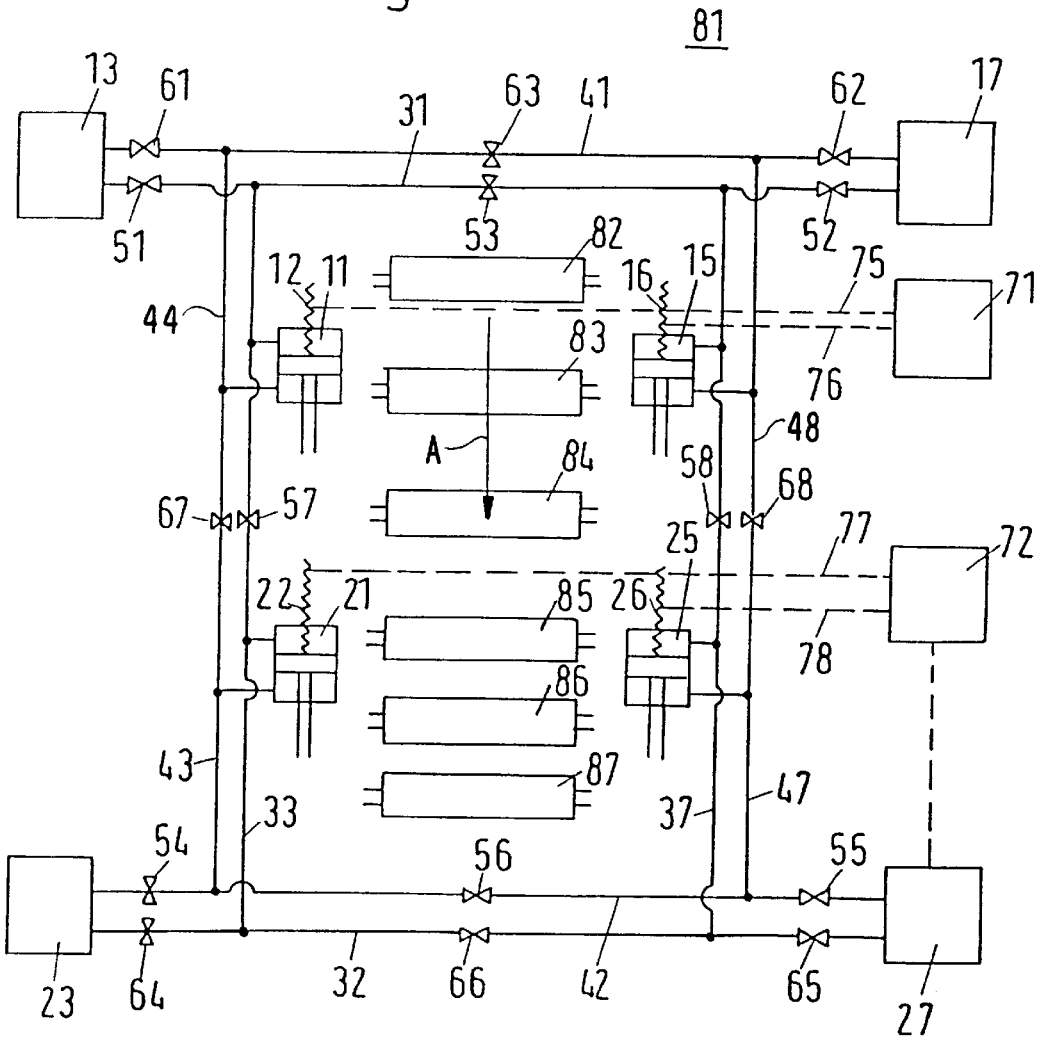
FIG. 1 is a schematic view of a strand guide with servo units of a segment according to an embodiment of the present invention.

The upper part and the lower part (not shown in the drawing) of the strand guide frame 81 are linked with one another by four servo piston-cylinder units 11, 15, 21, 25.

Referring to FIG. 1, the servo piston-cylinder units 11, 15, 21, 25 have position transmitters 12, 16, 22 and 26 which are connected with position regulators 71 and 72 by measurement lines 75 to 78.

In FIG. 1, the piston surface ends of the servo piston-cylinder units 11, 15, 21 and 25 are connected via hydraulic lines 31 to 38 and the other ends of the servo piston-cylinder units 11, 15, 21 and 25 are connected via hydraulic lines 41 to 48. The hydraulic lines 31 to 38 for the piston surfaces can be blocked by locking elements 51 to 58 and the hydraulic lines 41 to 48 of the ring surfaces can be blocked by locking elements 61 to 68.

In the present schematic circuit, servo piston-cylinder unit 11 can be driven individually by servo valve 13 and servo piston-cylinder unit 15 can be driven individually by servo valve 17, while, in the run-out, servo cylinder units 21 and 25 are linked jointly with servo valve 27 because locking elements 53, 57, 58, 63, 67 and 68 are closed and locking elements 56 and 66 are open.

Figure 2:
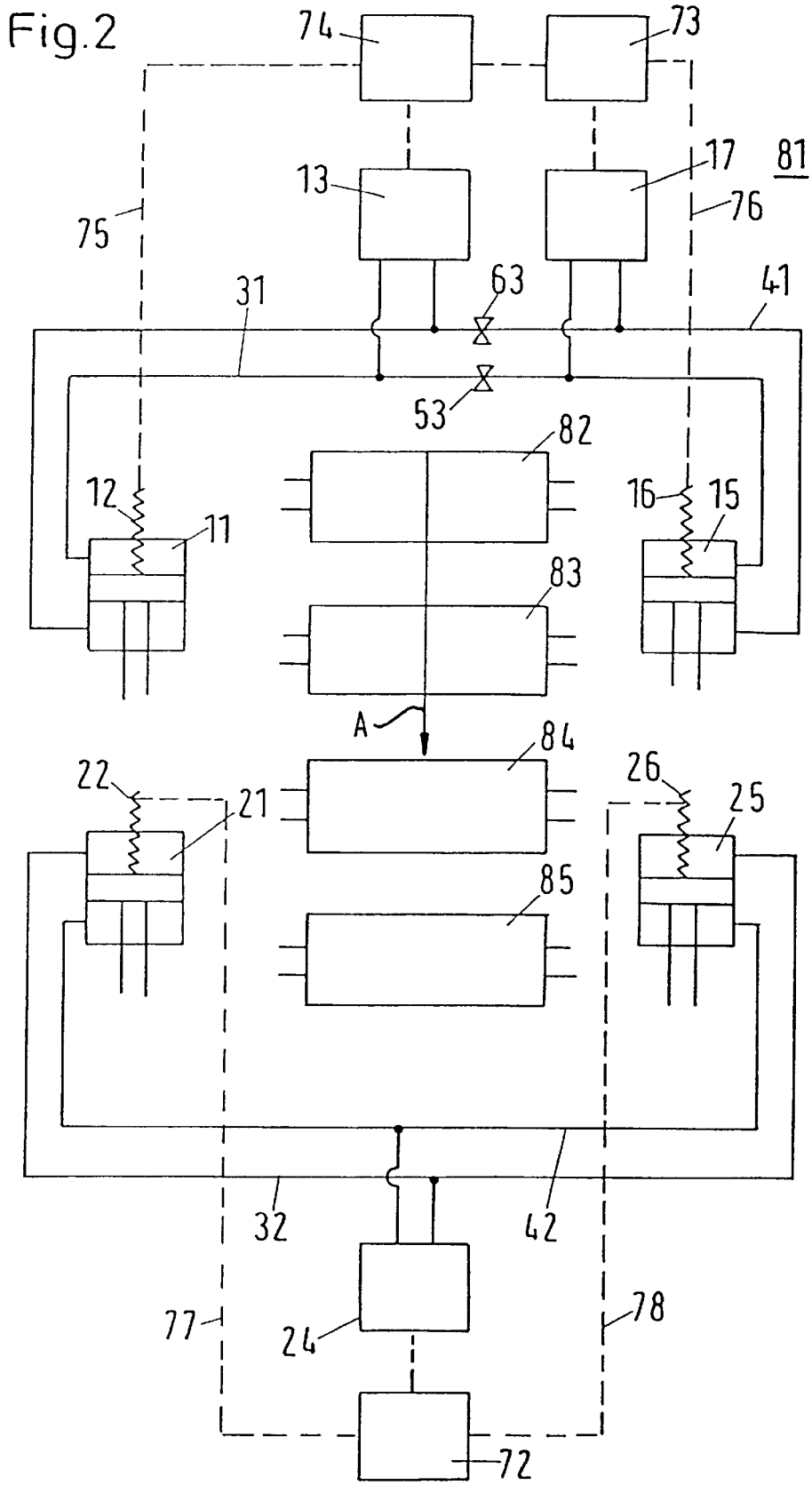
FIG. 2 is a schematic view of a segment of a strand guide with servo units linked at a strand run-in end and strand end of the segment.

In FIG. 2, servo piston-cylinder units of the run-in end of a segment 11, 15 are linked via hydraulic lines 31, 41 and servo piston cylinder units of 21, 25 of the run out end of the segment are linked via hydraulic lines 32, 42.

In the run-in region, servo valves 13, 17 can be linked with a servo piston-cylinder unit 11 and 15, respectively when the locking elements 53, 63 are closed, or each can be linked with both servo units 11 and 15 when the locking elements 53, 63 are open. In order to connect a servo valve 13 or 17 to the servo piston-cylinder units 11 and 15, the locking elements 53, 63 are opened and the servo valve which is not in operation is blocked by suitable hydraulic units.

When connecting a servo valve 13 or 17 to both servo piston-cylinder units 11, 25, this servo valve 13 or 17 is connected with position regulators 73 or 74 and, when connected jointly with the two position transmitters 12 and 16, the individual position regulators 73 or 74 are linked by measurement techniques via the measuring lines 75 or 76.

In the run-out end of the segment of the strand guide frame 81 in FIG. 2, only an individual servo valve 24 is provided for the servo piston-cylinder unit 21 and 25. This servo valve 24 is linked with a position regulator 72 which communicates via measurement technique with the position transmitters 22 and 26 via measurement lines 77 and 78.

What is claimed is:

1. A strand guide for use in a continuous casting plant for continuous casting of a strand having a soft reduction zone, comprising:

a segment having oppositely positioned strand guide rollers defining a gap between said rollers through which the strand is guidable;

four servo piston-cylinder units operatively connected to said segment for continuously adjusting said gap, each said four servo piston-cylinder units having a piston movably mounted within a cylinder, said piston dividing said cylinder into a first part on one side of said piston and a second part on the opposing side of said piston;

a position transmitter connected to each said four servo piston-cylinder units;

a shared servo valve connected to said first parts and said second parts of two adjacent ones of said four servo piston-cylinder units, wherein said position transmitters of said two adjacent ones of said four servo position-cylinder units are connected to a regulating means such that said two adjacent ones of said four servo piston-cylinder units are simultaneously adjustable as a unit in response to said shared servo valve; and an individual servo valve operatively connected to each of the other of said four servo piston-cylinder units so that said each of the other of said four servo piston-cylinder units is independently adjustable.

2. The strand guide of claim 1, further comprising a first set of hydraulic lines connecting said first parts of said four servo piston-cylinder units and a second set of hydraulic lines connecting said second parts of said four servo piston-cylinder units, said first and second sets of hydraulic lines comprising locking elements for selectively blocking sections of said first and second hydraulic lines so that said two adjacent ones of said four servo piston-cylinder units are simultaneously adjustable in response to said shared servo valve and each of the other of said four servo piston-cylinder units is independently adjustable in response to said individual servo valves.

3. The strand guide of claim 2, further comprising four servo valves selectively connectable to said first and second sets of hydraulic lines.

4. The strand guide of claim 2, wherein the strand enters said segment at a run-in side of said segment and exits said segment at a run-out side of said segment, said first and second hydraulic lines operatively connected such that said first and second parts of ones of said four servo piston-cylinder units at said run-side are hydraulically connectable with respective ones of said first and second parts of ones of said four servo piston-cylinder units at said run-out side.

5. The strand guide of claim 4, wherein said shared servo valve is connectable to said ones of said four servo piston-cylinder units at one of said run-in side and said run-out side and said individual servo valves are connectable to ones of said four servo piston-cylinder units at the other of said run-in side and said run-out side.

* * * * *